US010029493B2

(12) United States Patent
Kamigiku et al.

(10) Patent No.: US 10,029,493 B2
(45) Date of Patent: Jul. 24, 2018

(54) BASE MATERIAL PROCESSING APPARATUS AND METHOD OF PREDICTING MEANDERING

(71) Applicant: SCREEN HOLDINGS CO., LTD., Kyoto (JP)

(72) Inventors: Takashi Kamigiku, Kyoto (JP); Mitsuhiro Yoshida, Kyoto (JP)

(73) Assignee: SCREEN Holdings Co., Ltd., Kyoto (JP)

( * ) Notice: Subject to any disclaimer, the term of this patent is extended or adjusted under 35 U.S.C. 154(b) by 0 days.

(21) Appl. No.: 15/657,790

(22) Filed: Jul. 24, 2017

(65) Prior Publication Data

US 2018/0022119 A1 Jan. 25, 2018

(30) Foreign Application Priority Data

Jul. 25, 2016 (JP) ..... 2016-145058

(51) Int. Cl.
*B41J 15/04* (2006.01)
*B41J 13/00* (2006.01)
(Continued)

(52) U.S. Cl.
CPC ..... *B41J 13/0009* (2013.01); *B41J 11/008* (2013.01); *B41J 11/0095* (2013.01);
(Continued)

(58) Field of Classification Search
CPC ..... B41J 15/044; B41J 15/048; B41J 15/18; B41J 17/02; B41J 17/18; B41J 17/20;
(Continued)

(56) References Cited

U.S. PATENT DOCUMENTS 7,027,076 B2 * 4/2006 Ruiz ..... B41J 13/0009 347/190
7,086,714 B2 * 8/2006 Endo ..... B41J 11/0065 347/16

(Continued)

FOREIGN PATENT DOCUMENTS

JP 2003-182896 A 7/2003
JP 2008-155628 A 7/2008
JP 2016-088654 A 5/2016

*Primary Examiner* — Kristal Feggins
(74) *Attorney, Agent, or Firm* — McDermott Will & Emery LLP

(57) ABSTRACT

A base material processing apparatus detects the amount of widthwise misregistration of a base material in each detection position (Po, and Pa to Pd) lying on a transport path, and then calculates a difference between a detection value in the reference position (Po) and a detection value in each of the remaining detection positions (Pa to Pd) as a meandering amount. Subsequently, the base material processing apparatus determines coefficients obtained when a variation with time in each meandering amount is applied to a predetermined model function, and thereafter calculates coefficients of the model function predicted as the meandering of the base material in each processing position (P1 to P4), based on the determined coefficients and a positional relationship between the reference position (Po), the remaining detection positions (Pa to Pd) and the processing positions (P1 to P4). This achieves the prediction of the meandering of the base material in the processing positions (P1 to P4) with accuracy without any detector disposed in the processing positions (P1 to P4).

20 Claims, 11 Drawing Sheets

(51) Int. Cl.
*B41J 11/00* (2006.01)
*B41J 11/42* (2006.01)
*B65H 23/02* (2006.01)

(52) U.S. Cl.
CPC ..... *B41J 11/42* (2013.01); *B41J 15/04* (2013.01); *B65H 23/0204* (2013.01); *B65H 2557/242* (2013.01); *B65H 2601/272* (2013.01); *B65H 2801/15* (2013.01)

(58) Field of Classification Search
CPC ... B41J 15/00; B41J 15/04; B41J 15/16; B41J 11/58; B41J 11/0045; B41J 13/0009; B41J 11/42; B41J 11/0095; B41J 11/008; B65H 75/241
See application file for complete search history.

(56) References Cited

U.S. PATENT DOCUMENTS

| | | | | |
|---|---|---|---|---|
| 7,352,383 | B2 * | 4/2008 | Fukuyo ..... | B41J 2/32 347/221 |
| 2003/0116042 | A1 | 6/2003 | Ohba et al. | |
| 2008/0122889 | A1 | 5/2008 | Naoi et al. | |
| 2013/0112530 | A1 * | 5/2013 | Fujii ..... | G03G 15/1615 198/617 |
| 2016/0121627 | A1 | 5/2016 | Yoshida et al. | |

* cited by examiner

BASE MATERIAL PROCESSING APPARATUS AND METHOD OF PREDICTING MEANDERING

RELATED APPLICATIONS

This application claims the benefit of Japanese Application No. 2016-145058, filed on Jul. 25, 2016, the disclosure of which is incorporated by reference herein.

BACKGROUND OF THE INVENTION

Field of the Invention

The present invention relates to a technique for predicting the meandering of an elongated strip-shaped base material in a processing position lying on a transport path in a base material processing apparatus for processing the base material while transporting the base material.

Description of the Background Art

An inkjet image recording apparatus which records an image on elongated strip-shaped printing paper by ejecting ink from a plurality of recording heads while transporting the printing paper has heretofore been known. In the image recording apparatus of this type, inks of different colors are ejected from the respective recording heads. A multi-color image is recorded on a surface of the printing paper by superimposing single-color images formed by the respective color inks. The image recording apparatus of this type includes a detector for detecting the misregistration of the printing paper in the width direction thereof (which refers to a horizontal direction orthogonal to the longitudinal direction thereof hereinafter) for the purpose of controlling the position of ejection of inks toward the printing paper.

Such a conventional image recording apparatus including the detector is disclosed, for example, in Japanese Patent Application Laid-Open No. 2008-155628 and Japanese Patent Application Laid-Open No. 2003-182896. The apparatus disclosed in Japanese Patent Application Laid-Open No. 2008-155628 uses a plurality of line image sensors to detect the angle of skew of a recording medium, thereby adjusting the timing of ink ejection in accordance with the detected angle of skew (with reference to claims 1 and 2 and FIG. 1). The apparatus disclosed in Japanese Patent Application Laid-Open No. 2003-182896 includes two or more sensors for detecting edges of paper, and feeds a difference between outputs from the sensors where a constant time difference is established back to a corrector (with reference to claim 1 and FIG. 1).

Unfortunately, the image recording positions of the recording heads and the detection positions of the sensors are different on a transport path of the printing paper in the apparatuses disclosed in Japanese Patent Application Laid-Open No. 2008-155628 and Japanese Patent Application Laid-Open No. 2003-182896. In the configurations of these apparatuses, the widthwise positions of the printing paper in the respective recording positions accordingly do not precisely coincide with the detection results obtained from the respective sensors. For recording of an image of higher quality, it is necessary to identify the widthwise positions of the printing paper in the respective image recording positions. However, the recording heads are disposed in the respective recording positions of the printing paper. For this reason, it is often difficult in terms of space to place the sensors in addition to the recording heads in the respective recording positions. In particular, the space for the placement of the sensors is more limited in an apparatus which records an image across the full width of printing paper.

An apparatus disclosed in Japanese Patent Application Laid-Open No. 2016-88654 includes sensors disposed upstream and downstream of each recording position as seen in a transport direction, and calculates the widthwise position of printing paper in each recording position, based on the detection results from the sensors. This configuration is capable of predicting the widthwise position of the printing paper in each recording position without any detector disposed in each recording position. However, simple averaging of waveforms detected by the two sensors causes the amplitude of the resulting waveform to become smaller than the amplitude of the actual meandering waveform, as shown in FIG. 6 of Japanese Patent Application Laid-Open No. 2016-88654.

SUMMARY OF THE INVENTION

In view of the foregoing, it is therefore an object of the present invention to provide a technique capable of predicting the meandering of an elongated strip-shaped base material in a processing position without any detector disposed in the processing position in a base material processing apparatus for processing the base material while transporting the base material in a longitudinal direction thereof.

To solve the aforementioned problem, a first aspect of the present invention is intended for a base material processing apparatus comprising: a transport mechanism for transporting an elongated strip-shaped base material in a longitudinal direction thereof along a predetermined transport path; a processing part for processing the base material in a predetermined processing position lying on the transport path; a first detector for acquiring a variation with time in a first detection value indicative of the amount of widthwise misregistration of the base material in a first detection position lying on the transport path; a second detector for acquiring a variation with time in a second detection value indicative of the amount of widthwise misregistration of the base material in a second detection position lying on the transport path and downstream of the first detection position; a detection position coefficient calculation part for determining a first coefficient obtained when each of the variation with time in the first detection value and the variation with time in the second detection value is applied to a predetermined model function; and a processing position coefficient calculation part for calculating a second coefficient of the model function in the processing position, based on the first coefficient and a positional relationship between the first detection position, the second detection position and the processing position.

A second aspect of the present invention is intended for a base material processing apparatus comprising: a transport mechanism for transporting an elongated strip-shaped base material in a longitudinal direction thereof along a predetermined transport path; a processing part for processing the base material in a predetermined processing position lying on the transport path; a reference detector for acquiring a variation with time in a reference detection value indicative of the amount of widthwise misregistration of the base material in a reference position lying on the transport path; a first detector for acquiring a variation with time in a first detection value indicative of the amount of widthwise misregistration of the base material in a first detection position lying on the transport path; a second detector for acquiring a variation with time in a second detection value indicative of the amount of widthwise misregistration of the base material in a second detection position lying on the transport path and downstream of the first detection position; a meandering amount calculation part for calculating a first meandering amount and a second meandering amount, the first meandering amount being a difference between the reference detection value and the first detection value, the second meandering amount being a difference between the reference detection value and the second detection value; a detection position coefficient calculation part for determining a first coefficient obtained when each of the variation with time in the first meandering amount and the variation with time in the second meandering amount is applied to a predetermined model function; and a processing position coefficient calculation part for calculating a second coefficient of the model function in the processing position, based on the first coefficient and a positional relationship between the reference position, the first detection position, the second detection position and the processing position.

A third aspect of the present invention is intended for a method of predicting the meandering of an elongated strip-shaped base material in a predetermined processing position lying on a predetermined transport path while transporting the base material in a longitudinal direction thereof along the transport path. The method comprises the steps of: a) acquiring a variation with time in a first detection value indicative of the amount of widthwise misregistration of the base material in a first detection position lying on the transport path, and acquiring a variation with time in a second detection value indicative of the amount of widthwise misregistration of the base material in a second detection position lying on the transport path and downstream of the first detection position; b) determining a first coefficient obtained when each of the variation with time in the first detection value and the variation with time in the second detection value is applied to a predetermined model function; and c) calculating a second coefficient of the model function in the processing position, based on the first coefficient and a positional relationship between the first detection position, the second detection position and the processing position.

A fourth aspect of the present invention is intended for a method of predicting the meandering of an elongated strip-shaped base material in a predetermined processing position lying on a predetermined transport path while transporting the base material in a longitudinal direction thereof along the transport path. The method comprises the steps of: a) acquiring a variation with time in a reference detection value indicative of the amount of widthwise misregistration of the base material in a reference position lying on the transport path, acquiring a variation with time in a first detection value indicative of the amount of widthwise misregistration of the base material in a first detection position lying on the transport path, and acquiring a variation with time in a second detection value indicative of the amount of widthwise misregistration of the base material in a second detection position lying on the transport path and downstream of the first detection position; b) calculating a first meandering amount and a second meandering amount, the first meandering amount being a difference between the reference detection value and the first detection value, the second meandering amount being a difference between the reference detection value and the second detection value; c) determining a first coefficient obtained when each of the variation with time in the first meandering amount and the variation with time in the second meandering amount is applied to a predetermined model function; and d) calculating a second coefficient of the model function in the processing position, based on the first coefficient and a positional relationship between the reference position, the first detection position, the second detection position and the processing position.

The first to fourth aspects of the present invention are capable of predicting the meandering of the base material in the processing position without any detector disposed in the processing position.

DESCRIPTION OF THE PREFERRED EMBODIMENTS

A preferred embodiment according to the present invention will now be described with reference to the drawings.

<1. Configuration of Image Recording Apparatus>

Figure 1:
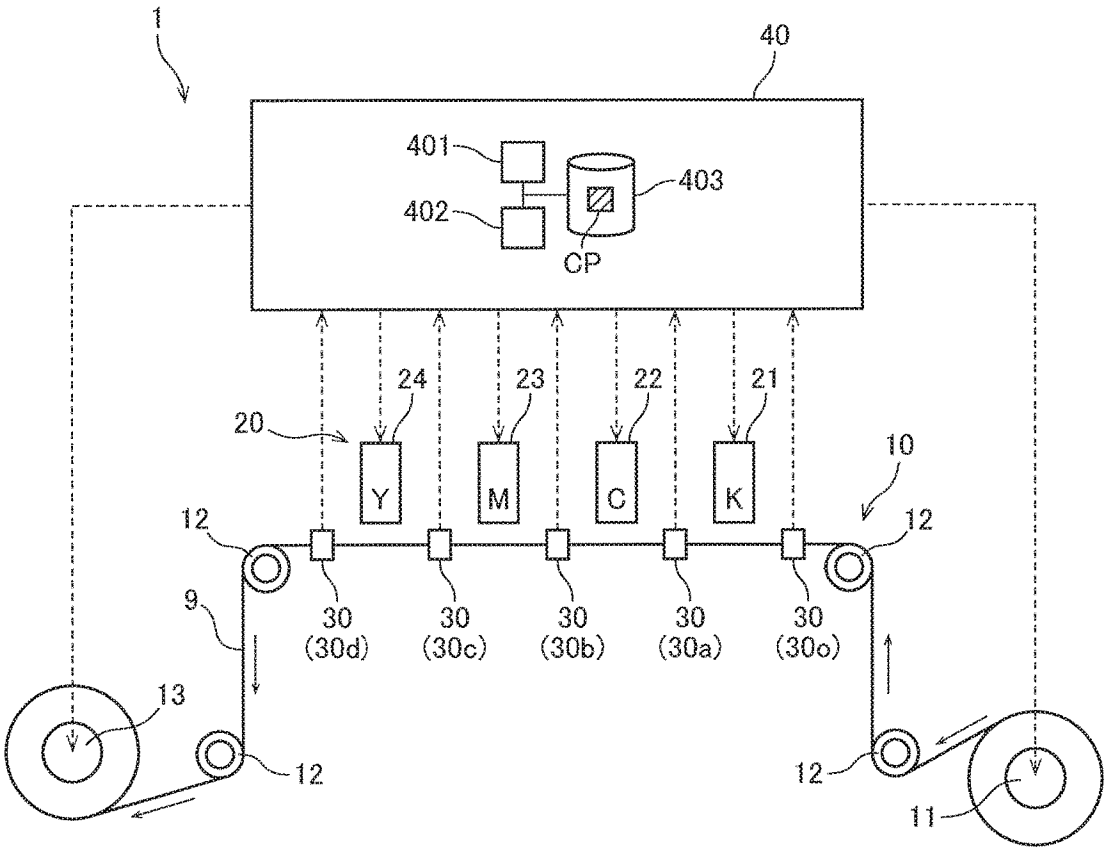
FIG. 1 is a diagram showing a configuration of an image recording apparatus.

FIG. 1 is a diagram showing a configuration of an image recording apparatus 1 that is an example of a base material processing apparatus according to the present invention. This image recording apparatus 1 is an inkjet printing apparatus which records an image on printing paper 9 that is an elongated strip-shaped base material by ejecting ink from a plurality of recording heads 21 to 24 toward the printing paper 9 while transporting the printing paper 9. As shown in FIG. 1, the image recording apparatus 1 includes a transport mechanism 10, an image recorder 20, a plurality of edge sensors 30 and a controller 40.

The transport mechanism 10 is a mechanism for transporting the printing paper 9 in a transport direction along the length of the printing paper 9. The transport mechanism 10 according to the present preferred embodiment includes an unwinder 11, a plurality of transport rollers 12, and a winder 13. The printing paper 9 is unwound from the unwinder 11, and is transported along a transport path formed by the transport rollers 12. Each of the transport rollers 12 rotates about a horizontal axis to guide the printing paper 9 downstream along the transport path. The transported printing paper 9 is wound and collected on the winder 13.

As shown in FIG. 1, the printing paper 9 is moved under the recording heads 21 to 24 substantially in parallel with a direction in which the recording heads 21 to 24 are arranged. During this movement, a recording surface of the printing paper 9 faces upwardly (toward the recording heads 21 to 24). The printing paper 9 runs over the transport rollers 12 while being held under tension. This prevents slack and wrinkles in the printing paper 9 during the transport.

The image recorder 20 is a processing part for ejecting ink droplets toward the printing paper 9 transported by the transport mechanism 10. The image recorder 20 according to the present preferred embodiment includes a first recording head 21, a second recording head 22, a third recording head 23 and a fourth recording head 24 which are equally spaced along the transport path of the printing paper 9.

Figure 2:
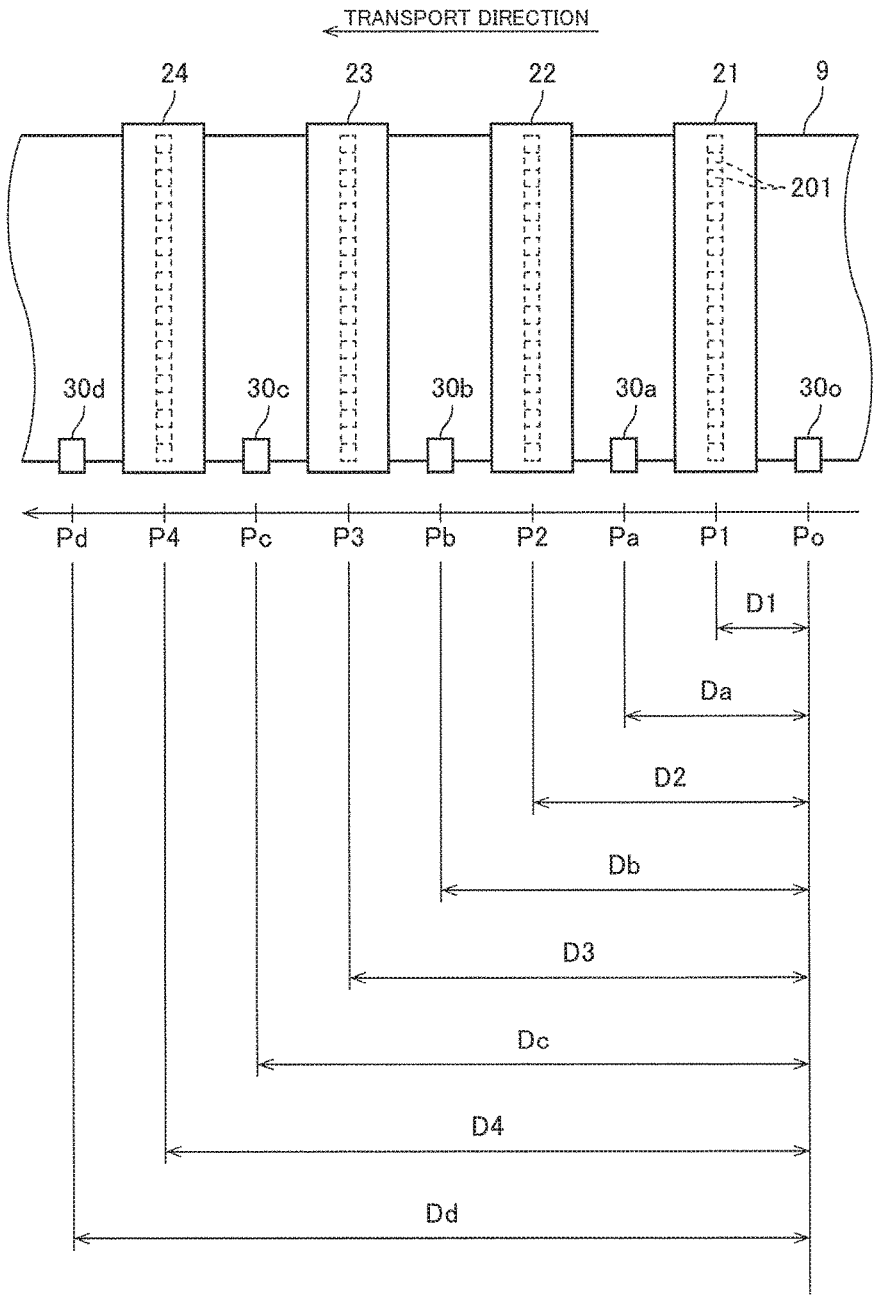
FIG. 2 is a partial top plan view of the image recording apparatus, and shows an image recorder and its surroundings.

FIG. 2 is a partial top plan view of the image recording apparatus 1, and shows the image recorder 20 and its surroundings. Each of the four recording heads 21 to 24 covers the entire width of the printing paper 9. As indicated by broken lines in FIG. 2, each of the recording heads 21 to 24 has a lower surface including a plurality of nozzles 201 arranged parallel to the width direction of the printing paper 9. The first, second, third and fourth recording heads 21, 22, 23 and 24 eject ink droplets of four colors, i.e., K (black), C (cyan), M (magenta) and Y (yellow), respectively, which serve as color components of a multi-color image from the nozzles 201 toward an upper surface of the printing paper 9.

Specifically, the first recording head 21 ejects K-color ink droplets toward the upper surface of the printing paper 9 in a first processing position P1 lying on the transport path. The second recording head 22 ejects C-color ink droplets toward the upper surface of the printing paper 9 in a second processing position P2 downstream of the first processing position P1. The third recording head 23 ejects M-color ink droplets toward the upper surface of the printing paper 9 in a third processing position P3 downstream of the second processing position P2. The fourth recording head 24 ejects Y-color ink droplets toward the upper surface of the printing paper 9 in a fourth processing position P4 downstream of the third processing position P3. In the present preferred embodiment, the first processing position P1, the second processing position P2, the third processing position P3 and the fourth processing position P4 are equally spaced in the transport direction of the printing paper 9.

Each of the four recording heads 21 to 24 ejects ink droplets to thereby record a single-color image on the upper surface of the printing paper 9. Then a multi-color image is formed on the upper surface of the printing paper 9 by superimposing the four single-color images. If the widthwise positions (positions as seen in the width direction) of the ink droplets ejected from the four recording heads 21 to 24 on the printing paper 9 do not coincide with each other, the image quality of a printed product is lowered. Controlling such misregistration between the single-color images on the printing paper 9 within an allowable range is an important factor for improvements in print quality of the image recording apparatus 1.

A dryer unit for drying the ink ejected onto the recording surface of the printing paper 9 may be further provided downstream of the recording heads 21 to 24 as seen in the transport direction. The dryer unit, for example, blows a heated gas toward the printing paper 9 to vaporize a solvent contained in the ink adhering to the printing paper 9, thereby drying the ink. The dryer unit may be of the type which dries the ink by other methods such as irradiation with light.

The edge sensors 30 are detectors for detecting the amount of widthwise misregistration of the printing paper 9. In the present preferred embodiment, the edge sensors 30 are provided in five locations: a location upstream of the first processing position P1 on the transport path, locations between the four processing positions Pt to P4, and a location downstream of the fourth processing position P4. The five edge sensors 30 are referred to hereinafter as a reference edge sensor 300, a first edge sensor 30*a*, a second edge sensor 30*b*, a third edge sensor 30*c* and a fourth edge sensor 30*d* which are arranged in order as seen from upstream.

As shown in FIG. 2, the reference edge sensor 30*o* is disposed in a reference position Po upstream of the first processing position P1. The first edge sensor 30*a* is disposed in a first detection position Pa lying between the first processing position P1 and the second processing position P2. The second edge sensor 30*b* is disposed in a second detection position Pb lying between the second processing position P2 and the third processing position P3. The third edge sensor 30*c* is disposed in a third detection position Pc lying between the third processing position P3 and the fourth processing position P4. The fourth edge sensor 30*d* is disposed in a fourth detection position Pd downstream of the fourth processing position P4.

Figure 3:
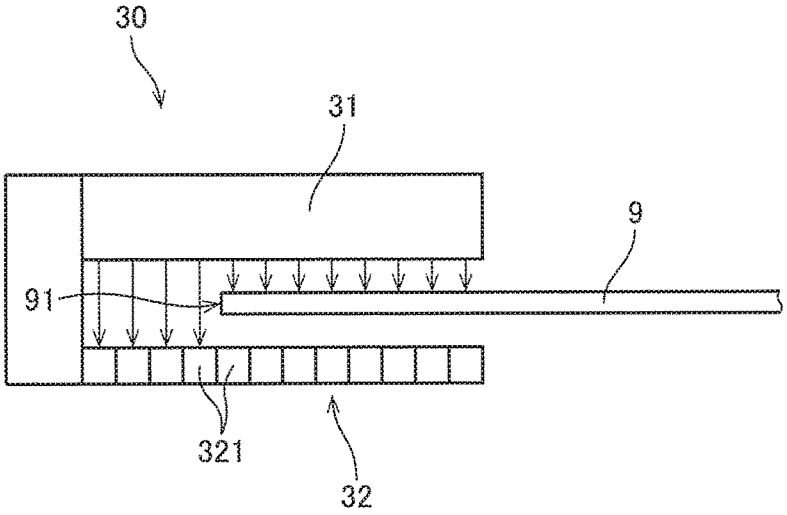
FIG. 3 is a view schematically showing a structure of edge sensors.

FIG. 3 is a view schematically showing a structure of the edge sensors 30. As shown in FIG. 3, each of the edge sensors 30 includes a light emitter 31 positioned over an edge 91 of the printing paper 9, and a line sensor 32 positioned under the edge 91. The light emitter 31 emits parallel light beams downwardly. The line sensor 32 includes a plurality of light receiving elements 321 arranged in the width direction. Outside the edge 91 of the printing paper 9, light beams emitted from the light emitter 31 enter the light receiving elements 321, so that the light receiving elements 321 detect the light beams, as shown in FIG. 3. On the other hand inside the edge 91 of the printing paper 9, light beams emitted from the light emitter 31 are intercepted by the printing paper 9, so that the light receiving elements 321 detect no light beams. The edge sensors 30 detect the position of the edge 91 of the printing paper 9, based on whether light beams are detected by these light receiving elements 321 or not.

The controller 40 controls the operations of the components in the image recording apparatus 1. As conceptually shown in FIG. 1, the controller 40 is formed by a computer including a processor 401 such as a CPU, a memory 402 such as a RAM, and a storage part 403 such as a hard disk drive. A computer program CP for executing a printing process is installed in the storage part 403. As indicated by broken lines in FIG. 1, the controller 40 is electrically connected to the transport mechanism 10, the four recording heads 21 to 24 and the five edge sensors 30 respectively. The controller 40 controls the operations of the aforementioned components in accordance with the computer program CP. Thus, the printing process in the image recording apparatus 1 proceeds.

During the execution of the printing process, the controller 40 predicts the meandering (fluctuations in widthwise position) of the printing paper 9 in the four processing positions P1 to P4, based on detection signals from the five edge sensors 30, to correct the ejection positions of ink droplets toward the printing paper 9 in the processing positions P1 to P4. This suppresses the aforementioned misregistration between the single-color images on the printing paper 9.

Figure 4:
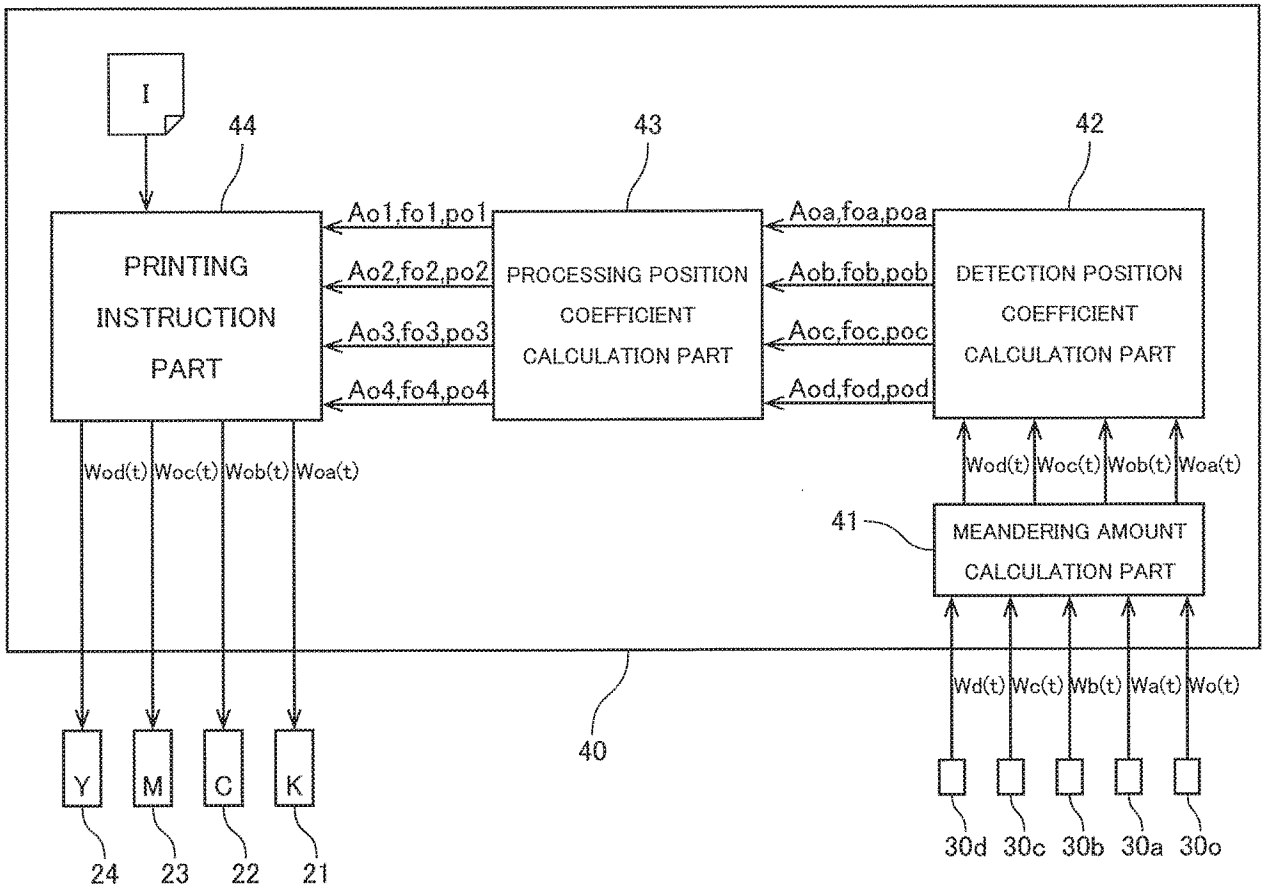
FIG. 4 is a block diagram conceptually showing functions in a controller.

FIG. 4 is a block diagram conceptually showing functions in the controller 40 for implementing such a correction process. As shown in FIG. 4, the controller 40 includes a meandering amount calculation part 41, a detection position coefficient calculation part 42, a processing position coefficient calculation part 43 and a printing instruction part 44. The processor 401 comes in operation, based on the computer program CP, whereby the functions of the meandering amount calculation part 41, the detection position coefficient calculation part 42, the processing position coefficient calculation part 43 and the printing instruction part 44 are implemented.

The meandering amount calculation part 41 calculates differences between detection values obtained from the five edge sensors 30 as meandering amounts. In the present preferred embodiment, the detection value obtained from the reference edge sensor 300 is defined as a reference detection value Wo(t). The meandering amount calculation part 41 calculates the difference between the reference detection value Wo(t) and a detection value Wa(t) obtained from the first edge sensor 30*a* as a first meandering amount Woa(t), the difference between the reference detection value Wo(t) and a detection value Wb(t) obtained from the second edge sensor 30*b* as a second meandering amount Wob(t), the difference between the reference detection value Wo(t) and a detection value Wc(t) obtained from the third edge sensor 30*c* as a third meandering amount Woc(t), and the difference between the reference detection value Wo(t) and a detection value Wd(t) obtained from the fourth edge sensor 30*d* as a fourth meandering amount Wod(t). Each of the meandering amounts Woa(t), Wob(t), Woc(t) and Wod(t) varies with time t.

The detection position coefficient calculation part 42 calculates coefficients obtained when the time-varying waveform of each of the meandering amounts Woa(t), Wob(t), Woc(t) and Wod(t) is applied to a predetermined model function. That is, the detection position coefficient calculation part 42 calculates the coefficients of the model function in each of the four detection positions Pa, Pb, Pc and Pd. Specifically, the detection position coefficient calculation part 42 applies the time-varying waveform of each of the meandering amounts Woa(t), Wob(t), Woc(t) and Wod(t) to a sine function to determine frequency components (phase, amplitude and wavelength) at the time of the best approximation. Examples of the method of calculation of the frequency components include a fast Fourier transform (FFT) technique, a particle filter technique, a neural network technique and the like.

The processing position coefficient calculation part 43 calculates coefficients of the model function predicted as the meandering of the printing paper 9 in each of the first to fourth processing position P1 to P4. Specifically, the processing position coefficient calculation part 43 calculates the coefficients of the model function in each of the first to fourth processing position P1 to P4 by means of proportional calculation, based on the coefficients calculated by the detection position coefficient calculation part 42 and a positional relationship between the reference position Po, the detection positions Pa to Pd and the processing positions P1 to P4. Thus, the processing position coefficient calculation part 43 predicts the time-varying waveforms of the meandering amounts in the respective processing positions P1 to P4.

The printing instruction part 44 outputs a printing instruction to each of the four recording heads 21 to 24, based on image data I to be printed. Each of the recording heads 21 to 24 ejects ink droplets from the nozzles 201 specified by the printing instruction according to the timing specified by the printing instruction. The printing instruction part 44 also corrects the printing instructions, based on the time-varying waveforms of the meandering amounts obtained from the processing position coefficient calculation part 43. Thus, the printing instruction part 44 corrects the ejection positions of the ink droplets in the processing positions P1 to P4.

<2. Procedure for Printing Process>

Figure 5:
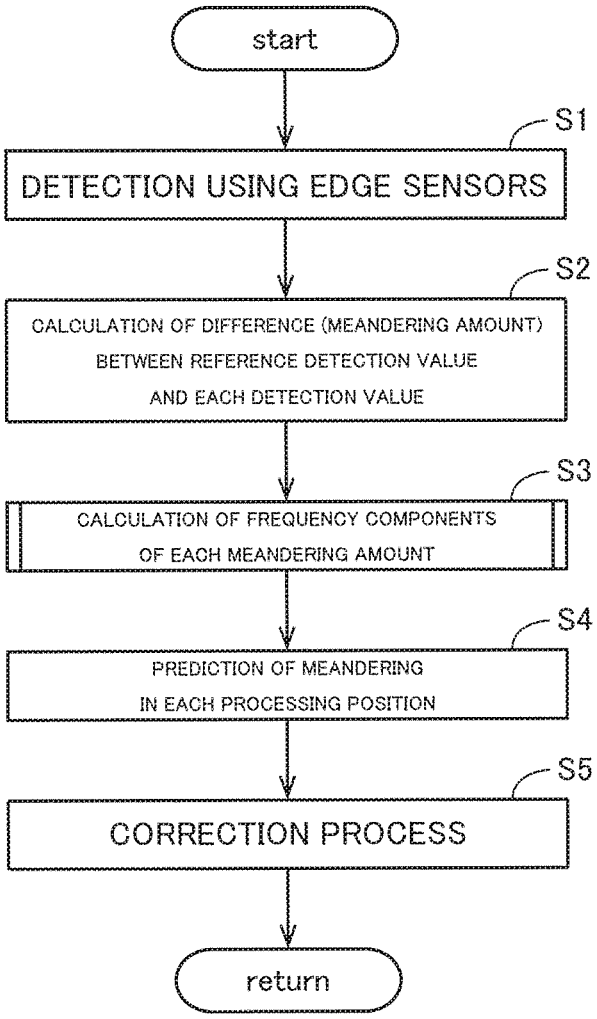
FIG. 5 is a flow diagram showing a procedure for a printing process.

The details of the printing process by means of the image recording apparatus 1 will be described with reference to the flow diagram of FIG. 5. During the recording of an image on the printing paper 9, the image recording apparatus 1 repeatedly performs the procedure shown in FIG. 5 while transporting the printing paper 9 along the transport path.

Upon starting the transport of the printing paper 9, the image recording apparatus 1 initially starts the detection process by means of the five edge sensors 30 (Step S1). The reference edge sensor 30*o* detects the amount of widthwise misregistration of the printing paper 9 in the reference position Po as the reference detection value Wo(t). The first edge sensor 30*a* detects the amount of widthwise misregistration of the printing paper 9 in the first detection position Pa as the first detection value Wa(t). The second edge sensor 30*b* detects the amount of widthwise misregistration of the printing paper 9 in the second detection position Pb as the second detection value Wb(t). The third edge sensor 30*c* detects the amount of widthwise misregistration of the printing paper 9 in the third detection position Pc as the third detection value Wc(t). The fourth edge sensor 30*d* detects the amount of widthwise misregistration of the printing paper 9 in the fourth detection position Pd as the fourth detection value Wd(t).

The five edge sensors 30 continuously detect the amounts of widthwise misregistration of the printing paper 9. Thus, each of the reference detection value Wo(t), the first detection value Wa(t), the second detection value Wb(t), the third detection value Wc(t) and the fourth detection value Wd(t) is obtained as information (time-series information) varying with time t.

The detection values obtained from the five edge sensors 30 are transmitted to the controller 40. After acquiring the detection values, the controller 40 then calculates the difference between the reference detection value Wo(t) and each of the first detection value Wa(t), the second detection value Wb(t), the third detection value Wc(t) and the fourth detection value Wd(t) (Step S2).

In Step S2, the meandering amount calculation part 41 solves Equations (1) to (4) to be described below to thereby calculate the first meandering amount Woa(t), the second meandering amount Wob(t), the third meandering amount Woc(t) and the fourth meandering amount Wod(t).

$$Woa(t)=Wa(t)-Wo(t-Da/V) \quad (1)$$

$$Wob(t)=Wb(t)-Wo(t-Db/V) \quad (2)$$

$$Woc(t)=Wc(t)-Wo(t-Dc/V) \quad (3)$$

$$Wod(t)=Wd(t)-Wo(t-Dd/V) \quad (4)$$

where Da, Db, Dc and Dd are distances from the reference position Po to the first detection position Pa, the second detection position Pb, the third detection position Pc and the fourth detection position Pd, respectively (with reference to FIG. 2); and V is a speed at which the transport mechanism 10 transports the printing paper 9.

Thus, Da/V in Equation (1) indicates the time required to transport the printing paper 9 from the reference position Po to the first detection position Pa. In Equation (1) is calculated the difference between the first detection value Wa(t) obtained at the time t and the reference detection value Wo(t−Da/V) obtained the time Da/V earlier than the time t. That is, the first meandering amount Woa(t) is the amount by which the first detection value Wa(t) differs from the reference detection value Wo in the same portion of the printing paper 9. If an edge itself of the printing paper 9 has small irregularities, this step is capable of calculating the amount of displacement of the printing paper 9 in the width direction between the reference position Po and the first detection position Pa while eliminating the influence of the irregularities. As a result, the first meandering amount Woa(t) indicating how much the printing paper 9 is displaced in the width direction between the reference position Po and the first detection position Pa is obtained with accuracy.

Likewise, the meandering amount calculation part 41 uses Equations (2), (3) and (4) described above to calculate the differences in the same portion of the printing paper 9, thereby obtaining the second meandering amount Wob(t), the third meandering amount Woc(t) and the fourth meandering amount Wod(t), respectively.

Subsequently, the controller 40 calculates the frequency components for the time-varying waveform of each of the first meandering amount Woa(t), the second meandering amount Wob(t), the third meandering amount Woc(t) and the fourth meandering amount Wod(t) (Step S3). In this step, the detection position coefficient calculation part 42 determines the coefficients obtained when the time-varying waveform of each of the first meandering amount Woa(t), the second meandering amount Wob(t), the third meandering amount Woc(t) and the fourth meandering amount Wod(t) is applied to a model function. An example of the model function used herein includes a sine function as expressed by:

$$W(t)=A\cdot\sin(2\pi ft+p) \tag{5}$$

where the coefficient A is the amplitude of the sine function; the coefficient f is the frequency of the sine function; and the coefficient p is the phase of the sine function. Specifically, the sine function approximating the time-varying waveform of each of the first meandering amount Woa(t), the second meandering amount Wob(t), the third meandering amount Woc(t) and the fourth meandering amount Wod(t) is determined as expressed by Equations (6) to (9) to be described below. Then, the amplitudes A (Aoa, Aob, Aoc and Aod), the frequencies f (foa, fob, foc and fod) and the phases p (poa, pob, poc and pod) of the respective sine functions are determined.

$$Woa(t)=Aoa\cdot\sin(2\pi\cdot foa\cdot t+poa) \tag{6}$$

$$Wob(t)=Aob\cdot\sin(2\pi\cdot fob\cdot t+pob) \tag{7}$$

$$Woc(t)=Aoc\cdot\sin(2\pi\cdot foc\cdot t+poc) \tag{8}$$

$$Wob(t)=Aod\cdot\sin(2\pi\cdot fod\cdot t+pod) \tag{9}$$

The detection position coefficient calculation part 42 uses, for example, a fast Fourier transform (FFT) technique, a particle filter technique and a neural network technique to determine the approximating sine functions.

Figure 6:
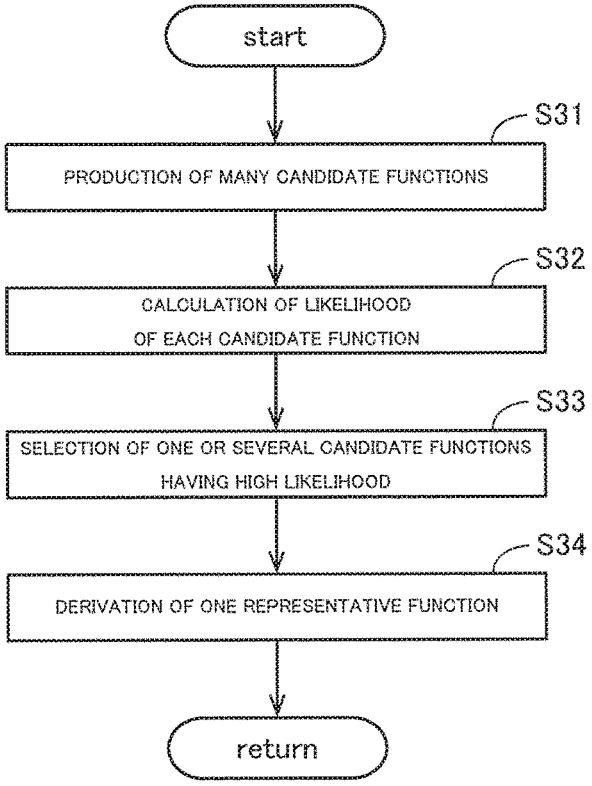
FIG. 6 is a flow diagram showing a procedure for determining an approximating sine function through the use of a particle filter.

FIG. 6 is a flow diagram showing a procedure for determining an approximating sine function using a particle filter. When the particle filter is used, a large number of sine functions (candidate functions) with the coefficients A, f and p varied randomly are produced (Step S31). Next, the large number of produced candidate functions are compared with the actual measured value of the meandering amount W(t), and a likelihood is calculated which indicates how close to the actual measured value each of the candidate functions is (Step S32). Then, one or several candidate functions having a high likelihood are selected (Step S33). Thereafter, one sine function (representative function) approximating the actual measured value of the meandering amount W(t) is derived based on the one or several selected candidate functions (Step S34). In Step S34, the representative function may be derived, for example, by averaging the several candidate functions having a high likelihood.

The determination of the approximating sine function through the use of the fast Fourier transform requires data corresponding to at least twice the period because of a sampling theorem. Thus, the obtained results reflect meandering characteristics corresponding to at least the last two periods. It is hence difficult to determine the sine function approximating the actual measured value with accuracy immediately after the meandering characteristics of the printing paper 9 are varied. On the other hand, the use of the particle filter as shown in FIG. 6 eliminates the need for sampling data as long as that for the fast Fourier transform to achieve the determination of the approximating sine function with accuracy immediately after the meandering characteristics are varied.

When the particle filter is used, it is also preferable to calculate the likelihood, based on sampling data corresponding to at least one period. For the calculation of the likelihood, greater weights may be assigned to newer data.

Also, the detection position coefficient calculation part 42 may use other machine learning techniques (for example, neural network) to determine the sine function approximating the actual measured value of the meandering amount. The neural network technique does not require sampling data as long as that for the fast Fourier transform. Thus, the neural network technique also achieves the determination of the sine function approximating the actual measured value with accuracy immediately after the meandering characteristics are varied.

After the process in Step S3 is completed, the controller 40 then predicts the time-varying waveform of meandering in each of the first processing position P1, the second processing position P2, the third processing position P3 and the fourth processing position P4 (Step S4). In Step S4, the processing position coefficient calculation part 43 calculates the amplitude A, the frequency f and the phase p of the sine function predicted as the meandering of the printing paper 9 in each of the processing positions P1 to P4, based on the amplitude A, the frequency f and the phase p calculated in Step S3 and a positional relationship between the reference position Po, the detection positions Pa to Pd and the processing positions P1 to P4.

Figure 7:
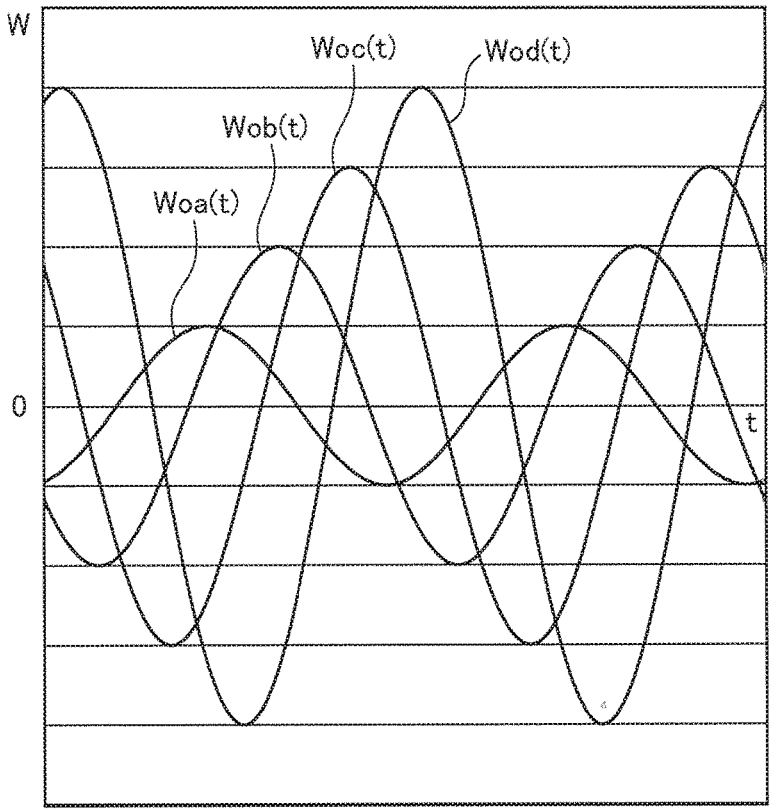
FIG. 7 is a graph showing examples of waveforms of a first meandering amount, a second meandering amount, a third meandering amount and a fourth meandering amount.
Figure 8:
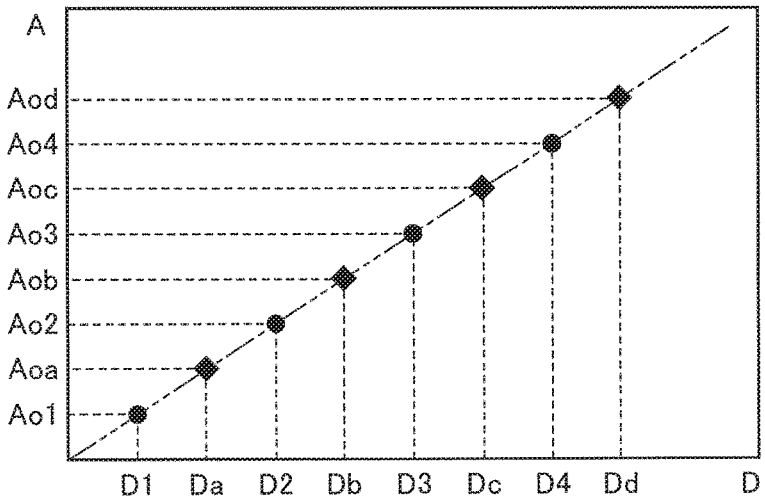
FIG. 8 is a graph showing a relationship between a distance from a reference position and the amplitude of the meandering amounts.

FIG. 7 is a graph showing examples of the time-varying waveforms of the first meandering amount Woa(t), the second meandering amount Wob(t), the third meandering amount Woc(t) and the fourth meandering amount Wod(t). As shown in FIG. 7, the amplitude A, the frequency f and the phase p of each meandering amount vary with the distance from the reference position Po (i.e., in the order of Woa(t), Wob(t), Woc(t) and Wod(t)). FIG. 8 is a graph showing a relationship between the distance D from the reference position Po and the amplitude A of the meandering amount W(t). In the example of FIG. 8, the distance D from the reference position Po and the amplitude A of the meandering amount W(t) are in proportional relation to each other.

The processing position coefficient calculation part 43 predicts the amplitude A, the frequency f and the phase p of the sine function in each of the processing positions P1 to P4, on the assumption that the positions lying on the transport path are in such a proportional relation to the amplitude A, the frequency f and the phase p of the meandering amount W(t).

Specifically, the amplitudes Ao1, Ao2, Ao3 and Ao4 of the respective sine functions in the first processing position P1, the second processing position P2, the third processing position P3 and the fourth processing position P4 are determined by:

$$Ao1=Aoa\cdot D1/Da \quad (10)$$

$$Ao2=(Aob-Aoa)\cdot(D2-Da)/(Db-Da)+Aoa \quad (11)$$

$$Ao3=(Aoc-Aob)\cdot(D3-Db)/(Dc-Db)+Aob \quad (12)$$

$$Ao4=(Aod-Aoc)\cdot(D4-Dc)/(Dd-Dc)+Aoc \quad (13)$$

Similarly, the frequencies fo1, fo2, fo3 and fo4 of the respective sine functions in the first processing position P1, the second processing position P2, the third processing position P3 and the fourth processing position P4 are determined by:

$$fo1=foa-D1/Da \quad (14)$$

$$fo2=(fob-foa)\cdot(D2-Da)/(Db-Da)+foa \quad (15)$$

$$fo3=(foc-fob)\cdot(D3-Db)/(Dc-Db)+fob \quad (16)$$

$$fo4=(fod-foc)\cdot(D4-Dc)/(Dd-Dc)+foc \quad (17)$$

Similarly, the phases po1, po2, po3 and po4 of the respective sine functions in the first processing position P1, the second processing position P2, the third processing position P3 and the fourth processing position P4 are determined by:

$$po1=poa\cdot D1/Da \quad (18)$$

$$po2=(pob-poa)\cdot(D2-Da)/(Db-Da)+poa \quad (19)$$

$$po3=(poc-pob)\cdot(D3-Db)/(Dc-Db)+pob \quad (20)$$

$$po4=(pod-poc)\cdot(D4-Dc)/(Dd-Dc)+poc \quad (21)$$

The sine functions predicted as the meandering of the printing paper 9 in the first processing position P1, the second processing position P2, the third processing position P3 and the fourth processing position P4 are determined by determining all of the aforementioned coefficients. This achieves the prediction of the time-varying waveforms of the meandering of the printing paper 9 in the first processing position P1, the second processing position P2, the third processing position P3 and the fourth processing position P4.

Thereafter, the controller 40 corrects the ejection positions of ink droplets from the recording heads 21 to 24, based on the predicted meandering of the printing paper 9 (Step S5). In Step S5, the printing instruction part 44 corrects the ejection positions of ink droplets from the recording heads 21 to 24, based on the sine functions with the amplitudes A, the frequencies f and the phases p calculated in Step S4 for the respective processing positions. The printing instruction part 44 outputs an after-correction printing instruction to each of the four recording heads 21 to 24. Each of the recording heads 21 to 24 ejects ink droplets from the nozzles 201 specified by the printing instruction according to the timing specified by the printing instruction. This achieves the recording of an image in an appropriate position on the printing paper 9 while suppressing the influence of the meandering.

As described above, the controller 40 of this image recording apparatus 1 determines the coefficients obtained when the time-varying waveform of the detection value in each of the detection positions is applied to the predetermined model function. Then, the controller 40 calculates the coefficients of the model function in each of the processing positions, based on the determined coefficients and the positional relationship between the detection positions and the processing positions, to thereby predict the time-varying waveform of the meandering of the printing paper 9 in each of the processing positions. Thus, the meandering of the printing paper 9 in each of the processing positions is predicted with accuracy without any edge sensor disposed in the processing positions.

<3. Modifications>

While the one preferred embodiment according to the present invention has been described hereinabove, the present invention is not limited to the aforementioned preferred embodiment.

Figure 9:
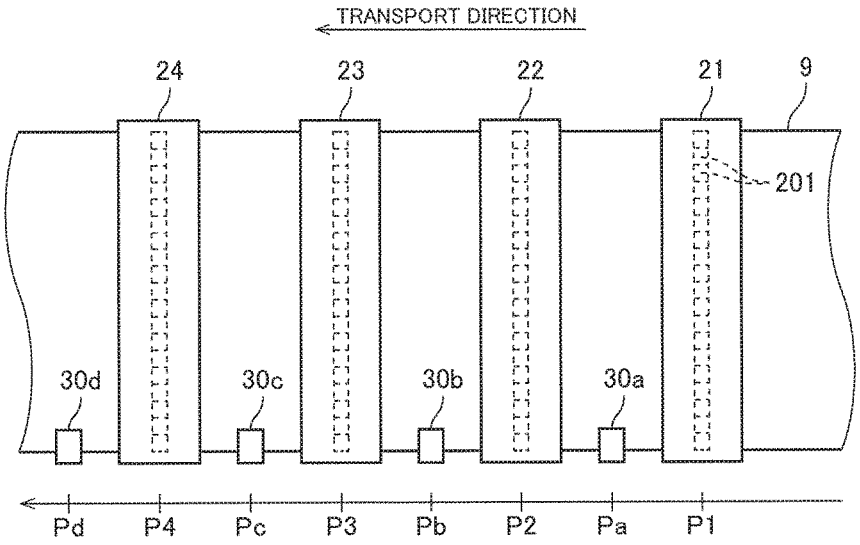
FIG. 9 is a partial top plan view of the image recording apparatus according to a modification.
Figure 10:
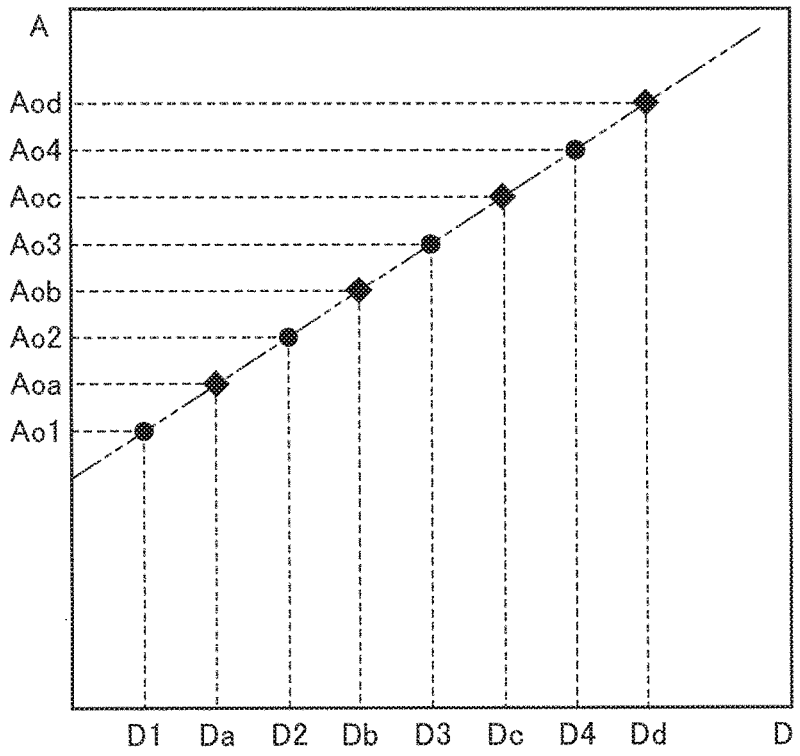
FIG. 10 is a graph showing a relationship between the distance from the reference position and the amplitude of the meandering amounts.

In the aforementioned preferred embodiment, the reference edge sensor 30*o* is provided in the reference position Po. Then, the difference between the detection value (reference detection value) obtained from the reference edge sensor 30*o* and the detection value obtained from each of the edge sensors is calculated. The frequency analysis is performed based on the difference. However, the reference edge sensor 30*o* may be dispensed with, as shown in FIG. 9. In this case, the aforementioned difference calculation process in Step S2 is dispensed with. Then, the frequency analysis on the detection values themselves of the edge sensors 30 in the respective detection positions Pa to Pd is performed in Step S3. Thus, the coefficients obtained when the time-varying waveform of the detection value of each of the edge sensors 30 is applied to the model function are determined. Then, as shown in FIG. 10, the coefficients of the model function in each of the processing position P1 to P4 are calculated, based on the obtained coefficients and the positional relationship between the detection positions Pa to Pd and the processing positions P1 to P4. Thus, the meandering of the printing paper 9 in each of the processing positions P1 to P4 is predicted.

With such a configuration, the meandering of the printing paper 9 in each of the processing positions is predicted with accuracy without any edge sensor 30 disposed in the processing positions P1 to P4.

Figure 11:
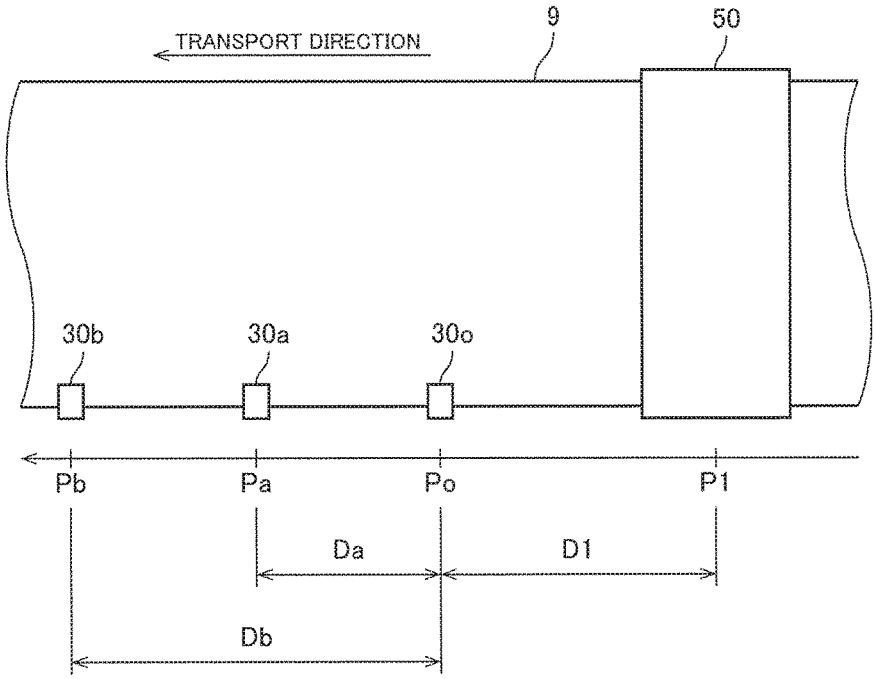
FIG. 11 is a partial top plan view of the image recording apparatus according to another modification.

In the aforementioned preferred embodiment, the ejection positions of ink droplets from the recording heads 21 to 24 are corrected based on the meandering of the printing paper 9. However, as shown in FIG. 11, the image recording apparatus may further includes a meandering correction part 50 for correcting the meandering of the printing paper 9. A mechanism for correcting the widthwise position of the printing paper 9, for example, by pivoting the rollers in the width direction is used for the meandering correction part 50. In this case, the controller 40 predicts the meandering of the printing paper 9 in the position of the meandering correction part 50. Specifically, while the meandering correction part 50 serves as the processing part and the position of the meandering correction part 50 serves as the processing position, the meandering of the printing paper 9 in the processing position is predicted in the same manner as in the aforementioned preferred embodiment. Then, the meandering correction part 50 performs the correction process, based on the time-varying waveform of the predicted meandering.

In the aforementioned preferred embodiment, the monadic sine function is used as the model function. However, the model function may be functions other than the sine functions. Alternatively, the model function may be composite functions having a plurality of terms.

In Step S4 according to the aforementioned preferred embodiment, the processing position coefficient calculation part 43 determines the coefficients of the model function in each of the processing positions, on the assumption that the positions lying on the transport path are in proportional relation to the coefficients of the model function. However, the relation between the positions lying on the transport path and the coefficients of the model function need not necessarily be the proportional relation. It is only necessary that there is a correlation predictable from a predetermined mathematical expression between the positions lying on the transport path and the coefficients of the model function.

In FIG. 2, the nozzles 201 are arranged in a line in the width direction in each of the recording heads 21 to 24. However, the nozzles 201 may be arranged in two or more lines in each of the recording heads 21 to 24.

In the aforementioned preferred embodiment, the transmission type edge sensors 30 are used as the detectors. However, other detection methods may be used for the detection in the detectors. For example, reflection type optical sensors, ultrasonic sensors and contact type sensors may be used. The detectors according to the present invention may be sensors for detecting a portion of the printing paper 9 other than edges. For example, the sensors may be of the type which reads or scans marks on the upper surface of the printing paper 9 or the grain (direction) of fibers of the printing paper 9 itself by means of a high-definition camera.

The edge sensors 30 are disposed only on one edge of the printing paper 9 in the aforementioned preferred embodiment. However, the sensors may be disposed in any position of the printing paper 9, such as on the other edge and in a middle portion of the printing paper 9 as seen in the width direction. Alternatively, a plurality of detectors may be disposed in the width direction of the printing paper 9.

The positions of the edge sensors 30 as seen in the transport direction need not necessarily lie near the recording heads 21 to 24. For accurate acquisition of the differences of the detection values between a reference detector and other detectors, it is preferable that the spacing between the reference detector and the other detectors as seen in the transport direction is not greater than one-half an estimated meandering wavelength.

In the aforementioned preferred embodiment, the four recording heads 21 to 24 are provided in the image recording apparatus 1. However, the number of recording heads in the image recording apparatus 1 may be in the range of one to three or not less than five. For example, a recording head for ejecting ink of a spot color may be provided in addition to those for K, C, M and Y.

The aforementioned image recording apparatus 1 records an image on the printing paper 9, based on inkjet technology. However, the base material processing apparatus according to the present invention may be an apparatus which records an image on the printing paper 9 by a method other than the inkjet method (for example, an electrophotographic process and exposure to light). The aforementioned image recording apparatus 1 performs the printing process on the printing paper 9 serving as the base material. However, the base material processing apparatus according to the present invention may be configured to perform a predetermined process on an elongated strip-shaped base material other than general paper (for example, a film made of resin, metal foil and glass).

Equations (1) to (21) in the aforementioned preferred embodiment are merely examples. Other equations that can accomplish similar objects may be used in place of Equations (1) to (21).

The components described in the aforementioned preferred embodiment and in the modifications may be consistently combined together, as appropriate.

While the invention has been described in detail, the foregoing description is in all aspects illustrative and not restrictive. It is understood that numerous other modifications and variations can be devised without departing from the scope of the invention.

What is claimed is:

1. A base material processing apparatus comprising:

a transport mechanism for transporting an elongated strip-shaped base material in a longitudinal direction thereof along a predetermined transport path;

a processing part for processing the base material in a predetermined processing position lying on said transport path;

a first detector for acquiring a variation with time in a first detection value indicative of the amount of widthwise misregistration of the base material in a first detection position lying on said transport path;

a second detector for acquiring a variation with time in a second detection value indicative of the amount of widthwise misregistration of the base material in a second detection position lying on said transport path and downstream of said first detection position;

a detection position coefficient calculation part for determining a first coefficient obtained when each of the variation with time in said first detection value and the variation with time in said second detection value is applied to a predetermined model function; and a processing position coefficient calculation part for calculating a second coefficient of said model function in said processing position, based on said first coefficient and a positional relationship between said first detection position, said second detection position and said processing position.

2. The base material processing apparatus according to claim 1, wherein said model function is a sine function, and said first and second coefficients include an amplitude, a frequency and a phase of said sine function.

3. The base material processing apparatus according to claim 2, wherein said detection position coefficient calculation part determines said amplitude, said frequency and said phase through the use of a Fourier transform.

4. The base material processing apparatus according to claim 2, wherein said detection position coefficient calculation part determines said amplitude, said frequency and said phase through the use of a particle filter or a neural network.

5. The base material processing apparatus according to claim 1, wherein said processing position coefficient calculation part calculates said second coefficient of said model function in said processing position, on the assumption that the positions lying on said transport path are in proportional relation to said first coefficient.

6. The base aerial processing apparatus according to claim 1, wherein said processing part is an image recorder for ejecting ink toward the base material, and the ejection position of said ink is corrected based on the model function with said second coefficient calculated by said processing position coefficient calculation part.

7. The base material processing apparatus according to claim 1, wherein said processing part is a meandering correction part for correcting the meandering of the base material, based on the model function with said second coefficient calculated by said processing position coefficient calculation part.

8. The base material processing apparatus according to claim 1, wherein each of said first and second detectors is an edge sensor for detecting the position of an edge of the base material.

9. A base material processing apparatus comprising:

a transport mechanism for transporting an elongated strip-shaped base material in a longitudinal direction thereof along a predetermined transport path;

a processing part for processing the base material in a predetermined processing position lying on said transport path;

a reference detector for acquiring a variation with time in a reference detection value indicative of the amount of widthwise misregistration of the base material in a reference position lying on said transport path;

a first detector for acquiring a variation with time in a first detection value indicative of the amount of widthwise misregistration of the base material in a first detection position lying on said transport path;

a second detector for acquiring a variation with time in a second detection value indicative of the amount of widthwise misregistration of the base material in a second detection position lying on said transport path and downstream of said first detection position;

a meandering amount calculation part for calculating a first meandering amount and a second meandering amount, said first meandering amount being a difference between said reference detection value and said first detection value, said second meandering amount being difference between said reference detection value and said second detection value;

a detection position coefficient calculation part for determining a first coefficient obtained when each of the variation with time in said first meandering amount and the variation with time in said second meandering amount is applied to a predetermined model function; and a processing position coefficient calculation part for calculating a second coefficient of said model function in said processing position, based on said first coefficient and a positional relationship between said reference position, said first detection position, said second detection position and said processing position.

10. The base material processing apparatus according to claim 9, wherein said meandering amount calculation part calculates a difference between said reference detection value and said first detection value in the same portion of the base material as said first meandering amount, and calculates a difference between said reference detection value and said second detection value in the same portion of the base material as said second meandering amount.

11. The base material processing apparatus according to claim 10, wherein said model function is a sine function, and said first and second coefficients include an amplitude, a frequency and a phase of said sine function.

12. The base material processing apparatus according to claim 9, wherein said model function is a. sine function, and said first and second coefficients include an amplitude, a frequency and a phase of said sine function.

13. A method of predicting the meandering of an elongated strip-shaped base material in a predetermined processing position lying on a predetermined transport path while transporting the base material in a longitudinal direction thereof along the transport path, said method comprising the steps of:

a) acquiring a variation with time in a first detection value indicative of the amount of widthwise misregistration of the base material in a first detection position lying on said transport path, and acquiring a variation with time in a second detection value indicative of the amount of widthwise misregistration of the base material in a second detection position lying on said transport path and downstream of said first detection position;

b) determining a first coefficient obtained when each of the variation with time in said first detection value and the variation with time in said second detection value is applied to a predetermined model function; and c) calculating a second coefficient of said model function in said processing position, based on said first coefficient and a positional relationship between said first detection position, said second detection position and said processing position.

14. The method according to claim 13, further comprising the step of e) correcting the meandering of the base material, based on the model function with said calculated second coefficient.

15. A method of predicting the meandering of an elongated strip-shaped base material in a predetermined processing position lying on a predetermined transport path while transporting the base material in a longitudinal direction thereof along the transport path, said method comprising the steps of:

a) acquiring a variation with time in a reference detection value indicative of the amount of widthwise misregistration of the base material in a reference position lying on said transport path, acquiring a variation with time in a first detection value indicative of the amount of widthwise misregistration of the base material in a first detection position lying on said transport path, and acquiring a variation with time in a second detection value indicative of the amount of widthwise misregistration of the base material in a second detection position lying on said transport path and downstream of said first detection position;

b) calculating a first meandering amount and a second meandering amount, said first meandering amount being a difference between said reference detection value and said first detection value, said second meandering amount being a difference between said reference detection value and said second detection value;

c) determining a first coefficient obtained when each of the variation with time in said first meandering amount and the variations with time in said second meandering amount is applied to a predetermined model function; and d) calculating a second coefficient of said model function in said processing position, based on said first coefficient and a positional relationship between said reference position, said first detection position, said second detection position and said processing position.

16. The method according to claim 15, wherein in said step b), a difference between said reference detection value and said first detection value in the same portion of the base material is calculated as said first meandering amount, and a difference between said reference detection value and said second detection value in the same portion of the base material is calculated as said second meandering amount.

17. The method according to claim 15, wherein said model function is a sine function, and said first and second coefficients include an amplitude, a frequency and a phase of said sine function.

18. The method according to claim 17, wherein in said step c), said amplitude, said frequency and said phase are determined through the use of a Fourier transform.

19. The method according to claim 17, wherein in said step c), said amplitude, said frequency and said phase are determined through the use of a particle filter or a neural network.

20. The method according to claim 15, wherein in said step d), said second coefficient of said model function in said processing position is calculated, on the assumption that the positions lying on said transport path are in proportional relation to said first coefficient.

* * * * *